US005085579A

United States Patent [19]

Moore, Jr. et al.

[11] Patent Number: 5,085,579

[45] Date of Patent: Feb. 4, 1992

[54] POWERED CHAMBER COMBUSTION SYSTEM AND BURNER THEREFOR

[75] Inventors: Henry J. Moore, Jr., Playa Del Rey; Bijan Gidanian, Granada Hills, both of Calif.

[73] Assignee: Mor-Flo Industries, Inc., Cleveland, Ohio

[21] Appl. No.: 674,124

[22] Filed: Mar. 25, 1991

[51] Int. Cl.[5] ..... F23D 3/40

[52] U.S. Cl. ..... 431/326; 431/310; 431/312; 126/351; 239/553.3; 122/4 A

[58] Field of Search ..... 431/326, 311, 300, 302, 431/312, 314, 329; 126/387, 390, 391, 392, 351-361; 239/553.3, 553, 553.5; 122/182 S, 20 B, 18, 17, 121, 169, 4 A

[56] References Cited

U.S. PATENT DOCUMENTS

| | | | |
|---|---|---|---|
| 1,116,912 | 11/1914 | Parisen . | |
| 1,451,716 | 4/1923 | Sharpe | 239/553 |
| 1,935,919 | 11/1933 | Ronstrom | 122/16 |
| 2,385,854 | 10/1945 | Wolfersperger | 158/99 |
| 2,799,288 | 7/1957 | Knight | 137/98 |
| 3,199,572 | 8/1965 | Boulet | 158/116 |
| 3,280,774 | 10/1966 | English | 110/162 |
| 3,741,710 | 6/1973 | Nelson | 431/90 |
| 3,759,230 | 9/1973 | Cooksley | 122/156 |
| 4,114,813 | 9/1978 | Suga | 239/553.5 |
| 4,204,832 | 5/1980 | Miller | 431/20 |
| 4,257,355 | 3/1981 | Cook | 122/17 |
| 4,303,042 | 12/1981 | Sumiyoshi | 122/17 |
| 4,336,820 | 6/1982 | Jorgensen et al. | 137/100 |
| 4,385,723 | 5/1983 | Sanborn et al. | 236/18 |
| 4,385,887 | 5/1983 | Yamamoto et al. | 431/90 |
| 4,445,464 | 5/1984 | Gerstmann et al. | 122/16 |
| 4,449,484 | 5/1984 | Sakamoto et al. | 122/13 R |
| 4,472,132 | 9/1984 | Hisaoka et al. | 431/158 |
| 4,541,410 | 9/1985 | Jatana | 126/362 |
| 4,641,631 | 2/1987 | Jatana | 126/101 |
| 4,766,883 | 8/1988 | Cameron et al. | 126/351 |
| 4,793,800 | 12/1988 | Vallett et al. | 431/328 |
| 4,824,024 | 4/1989 | Bishop et al. | 239/553.3 |
| 4,925,093 | 5/1990 | Moore, Jr. et al. | 237/19 |
| 5,022,352 | 6/1991 | Osborne | 126/17 |

FOREIGN PATENT DOCUMENTS

| | | | |
|---|---|---|---|
| 0104586 | of 1983 | European Pat. Off. . | |
| 0110071 | of 1983 | European Pat. Off. . | |
| 53-24140 | of 1978 | Japan . | |
| 125509 | 6/1986 | Japan | 431/312 |
| 1537239 | of 1978 | United Kingdom . | |
| 1565310 | of 1980 | United Kingdom . | |
| 2177493 | of 1987 | United Kingdom . | |

OTHER PUBLICATIONS

"Negative Pressure Regulators (Zero Governors)", by Robert Shaw Controls.

Honeywell Publication Form No. 68-0044-2, by Honeywell, Inc., 1984.

*Primary Examiner*—Larry Jones

*Attorney, Agent, or Firm*—Body, Vickers & Daniels

[57] ABSTRACT

A forced draft gas burning water and/or space heater having a screen type vertically extending tubular burner provided with a deflector plate supported transversely within the burner tube for free vertical sliding movement therein on a vertical extending guide rod mounted in the burner tube. At the outset of each heating cycle of the heater, the pressurized combustible gas/air mixture initially forced upwardly into the open lower end of the burner tube pushes the deflector plate upwardly therein along the guide rod and is deflected thereby laterally outward through the apertured screen wall of the burner tube into the bottom region of the combustion chamber of the heater to cause immediate ignition of the initial combustible gas/air mixture by the igniter means located within the combustion chamber and eliminate any sputtering ignition effect.

47 Claims, 4 Drawing Sheets

FIG. 3
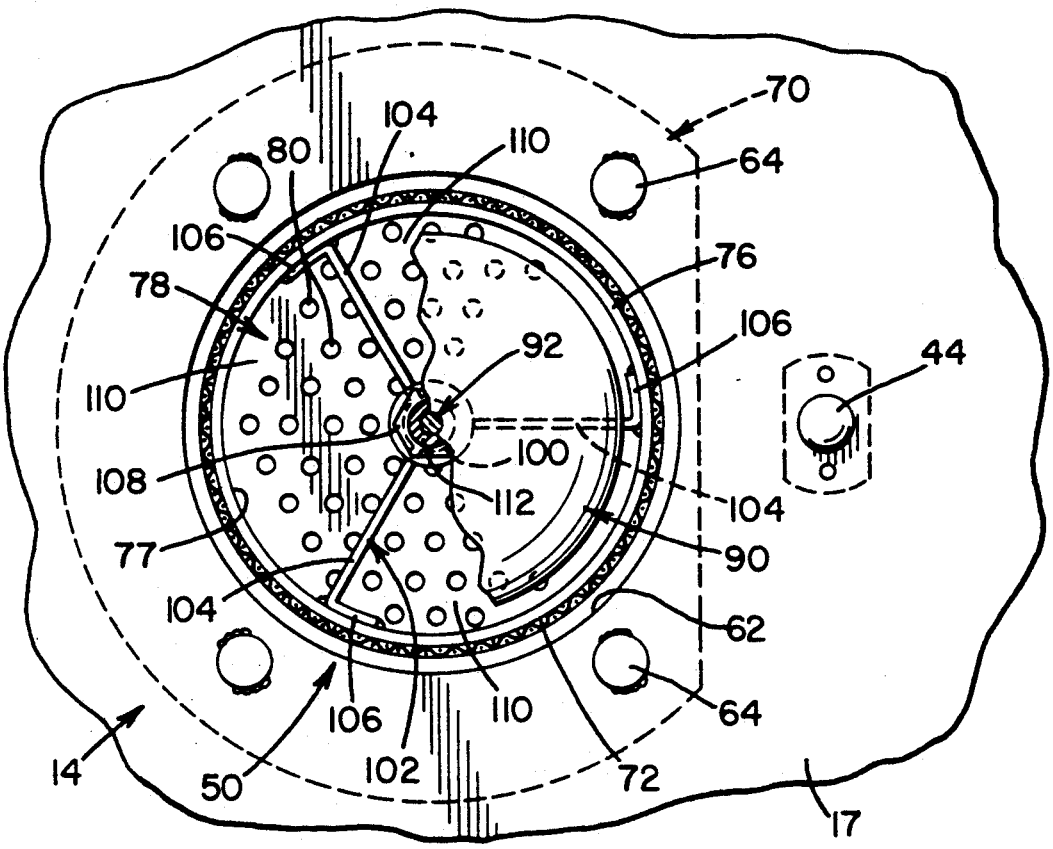
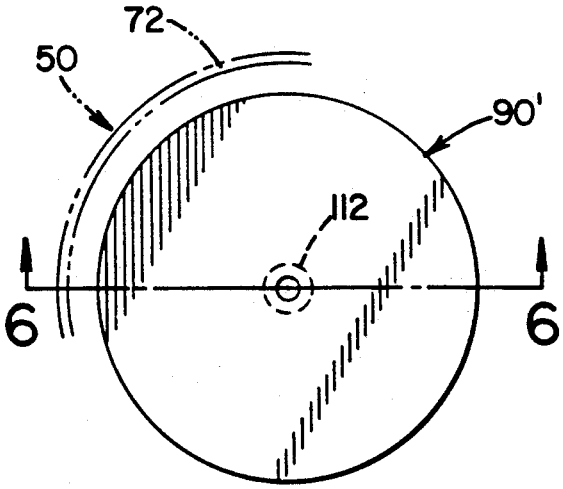
FIG. 5
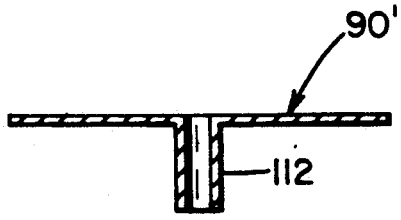
FIG. 6
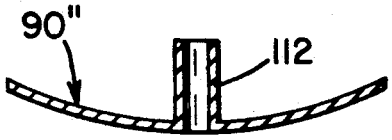
FIG. 7

POWERED CHAMBER COMBUSTION SYSTEM AND BURNER THEREFOR

The present invention relates generally to so-called powered chamber or forced draft combustion systems and more particularly to a burner construction therefor The invention is particularly adapted for use in water and/or space heating appliances provided with such powered chamber combustion systems.

BACKGROUND OF THE INVENTION

Highly fuel efficient gas burning water and/or space heating appliances, generally known as power burner, power assist, or power chamber type appliances, have been recently developed which are provided with powered or forced draft combustion systems employing a blower for forcing the gas/air combustion mixture to the burner and into the combustion chamber of the heating appliance. One such high efficiency power assist water heating appliance is disclosed in U.S. Pat. No. 4,766,883 to Cameron et al., which patent is assigned to the same assignee as that of the present application and the disclosure of which is incorporated herein by reference. This patent discloses a water heating apparatus in which a combustible gas/air mixture is introduced into a blower which moves the mixture under pressure into a vertically extending tubular burner within a closed combustion chamber contained within a tank containing water. The products of combustion exit the combustion chamber and pass through a helical tube of several turns within the body of water. The heat of combustion is extracted from the products of combustion by conduction through the walls of the combustion chamber and the helical exhaust tube. A high efficiency water heater thereby results. The heated water from the water heater may also be used to heat the air of a home or building by piping the hot water to a heat exchanger contained within the ducts of the home ventilation or heating system.

While this apparatus provides a highly efficient water and/or air heater, certain problems nevertheless are present. Thus, in the closed combustion chamber of such an apparatus assisted with a blower, the ignition of the gas/air mixture, when it is first introduced into the combustion chamber from the burner, is often delayed. This delay is due to factors such as the size and arrangement of the combustion chamber, the velocity and temperature of the combustible gas/air mixture entering the chamber, and the location of the ignition source. Depending on the length of the delay, an explosion may occur that ranges in magnitude from a small backlash to a forceful one that could damage the appliance. In some instances, this delay can be controlled by directing the gas/air mixture from the burner toward the ignition source in the combustion chamber as the mixture enters the chamber.

In general, however, even at the smoothest of ignition of the gas/air mixture, a delay may be present that causes a phenomenon which is known as sputtering. This is caused by the back pressure created by the initial ignition of the gas/air mixture. When the mixture is first ignited, the product of combustion occupies more volume than the mixture originally had occupied. This exerts a back pressure on the incoming mixture which in effect starves the chamber of combustible mixture. This in turn causes a momentary flame outage and a break in the combustion process. The blower, however, overcomes the back pressure and the gas/air mixture enters the combustion chamber and reignites. This process, producing a sputtering effect, is repeated a few times until the blower overcomes the back pressure of ignition and continuous combustion then occurs.

SUMMARY OF THE INVENTION

The present invention contemplates new and improved apparatus which overcomes all of the above referred to problems and others and provides a gas burning water heating and/or space heating appliance in which the ignition time of the combustible gas/air mixture is reduced to a minimum and sputtering of the ignition process is minimized or eliminated.

In accordance with one aspect of the invention, a substantially flat deflector plate or disc is disposed transversely within the tubular burner of the water heating apparatus and is freely movable vertically up and down therein. The deflector plate substantially conforms in contour to and transversely spans a substantial portion of the interior width of the tubular burner, and it is normally in its lowest or off position within the burner when. the gas/air mixture blower first comes on and is pushed up to its upper or operative position within the burner by the pressure thereagainst of the moving gas/air mixture as it is forced upwardly into the tubular burner by the blower.

The deflector plate performs two functions as it is moved upwardly within the tubular burner, by the pressure of the blower driven gas/air mixture, from its lowest or off position to its highest or operating position within the burner. Initially, as the blower first comes on, the gas/air mixture entering the bottom of the tubular burner is immediately distributed and directed by the deflector plate laterally outward of the burner toward the ignition source which is generally located within the bottom region of the combustion chamber at a level opposite or below the bottom of the burner therein. This laterally outward directed initially entering gas/air mixture is immediately ignited in the combustion chamber by the ignition source, thereby reducing the ignition time of the gas/air mixture from the burner to a minimum or preventing any delay therein. Secondly, when the gas/air mixture is thus first ignited and the back pressure of the ignition is created within the combustion chamber, the deflector plate directs this initial back pressure away from the burner and upwardly of the combustion chamber toward the exhaust gas exit tube thereof which is normally located at the top of the chamber. This, in effect, eliminates the temporary break in the combustion process and minimizes or eliminates the aforementioned sputtering ignition effect, thus in turn resulting in a smooth ignition of the gas/air mixture within the combustion chamber.

According to a further aspect of the invention, the deflector plate is freely slidable vertically up and down within the tubular burner on a centrally located vertically extending guide rod mounted inside the burner. The deflector plate is in its lowest or off position within the tubular burner when the gas/air blower first comes on, and it is pushed upwardly to its upper position within the burner by the force of the gas/air mixture directed upwardly into and through the tubular burner by the blower.

According to another feature of the invention, the deflector plate may be formed in a downwardly or upwardly facing concave shape instead of as a plain flat plate, and it may be shaped with flanges if desired. Also, the plate may be disc or round shape conforming to the cylindrical interior of the tubular burner, or it may be of square or any other contour shape. The size of the deflector plate may also vary based on the shape and arrangement of the combustion train.

According to a still further feature of the invention, the guide rod on which the deflector plate is vertically slidable is fastened vertically in the center of the burner at the top and bottom thereof, and a spider bracket supports and centrally locates the guide rod at the bottom of the burner, the openings between the radial arms of the spider bracket providing passageways for the passage of the gas/air mixture into the burner from the blower.

The principal object of the invention is to provide a water heating appliance of the power assist type in which the ignition time of the combustible gas/air mixture introduced into the combustion chamber of the appliance is reduced to a minimum and is effected substantially without any delay.

Another object of the invention is to provide a water heating appliance of the above referred to type characterized by a smooth and quick ignition of the combustible gas/air mixture within the combustion chamber of the appliance.

Still another object of the invention is to provide a water heating appliance of the above-referred to type in which sputtering of the ignition of the combustible gas/air mixture within the combustion chamber of the appliance is effectively minimized or prevented.

A further object of the invention is to provide a water heating appliance of the above-referred to power assist type with a burner construction which will substantially minimize or eliminate any delay in the ignition of the combustible gas/air mixture when first introduced from the burner into the combustion chamber of the appliance.

A still further object of the invention is to provide a water heating appliance of the above-referred to type with a burner construction which effects smooth ignition in the combustion chamber of the appliance of the combustible gas/air mixture as it is force fed to the burner by the blower.

Yet another object of the invention is to provide a water heating appliance of the above-referred to power assist type with a burner construction which will effectively eliminate all sputtering type ignition of the combustible gas/air mixture within the combustion chamber of the appliance as it is introduced thereinto from the burner.

Further objects and advantages of the invention will occur from the following detailed description of a preferred embodiment thereof and from the accompanying drawings in which:

FIG. 3 is a cross-sectional view of the burner taken along line 3—3 of FIG. 2;

FIGS. 5 and 6 are a plan view, and a sectional view on the line 6—6 of FIG. 5, of a modified form of deflector plate; and, FIG. 7 is a sectional view of another modified form of deflector plate.

DESCRIPTION OF THE PREFERRED EMBODIMENT

Figure 1:
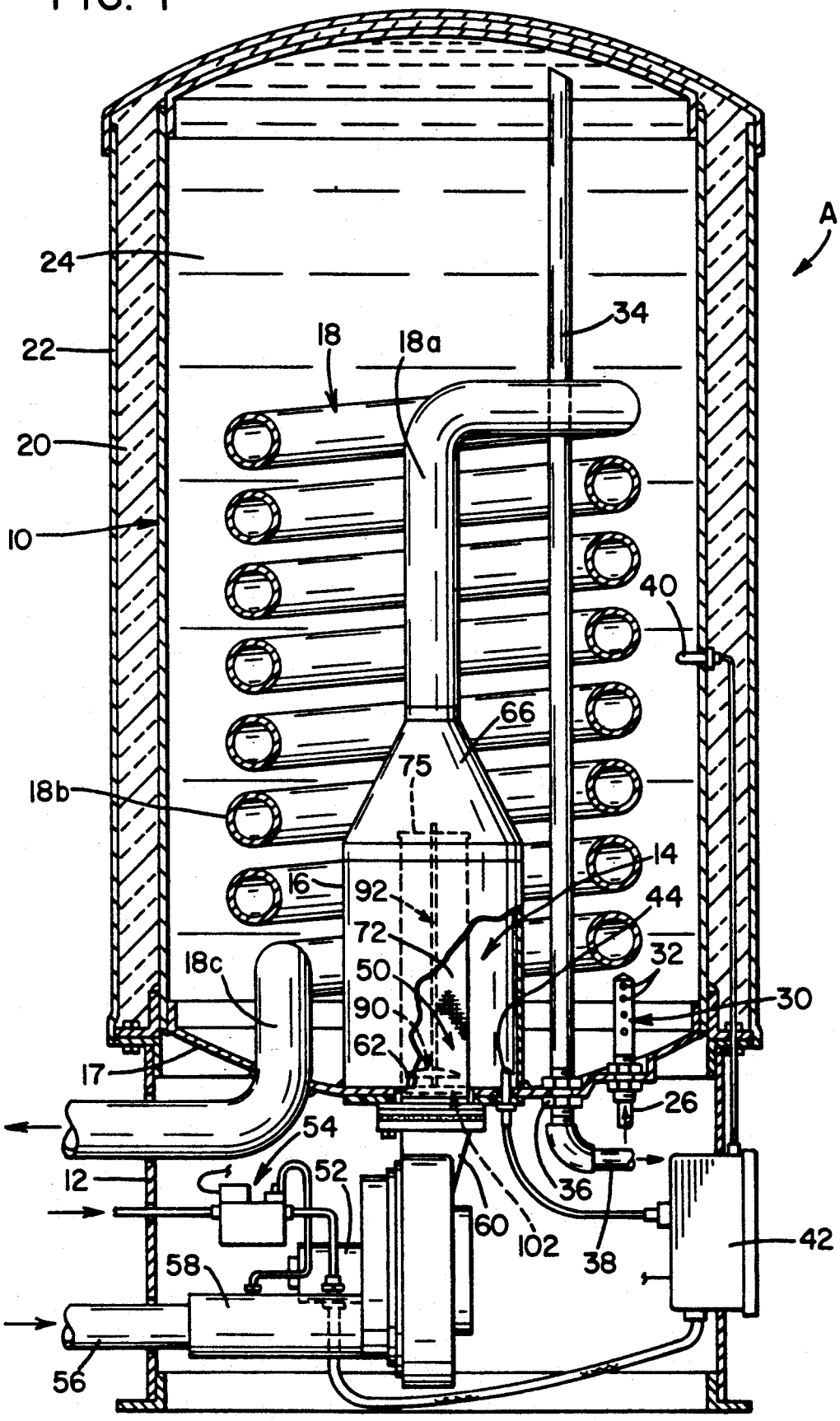
FIG. 1 is a side elevation, partly in vertical section, of a water heating appliance comprising the invention showing the major elements thereof.

Referring now to the drawings wherein the showings are for the purposes of illustrating a preferred embodiment of the invention only and not for the purposes of limiting same, the Figures show a water heating appliance A comprised of a cylindrical stainless steel water containing tank 10 supported in upright position upon a cylindrical metal base 12 and containing a combustion chamber 14 located at the bottom of the tank and defined in part by an upstanding stainless steel cylindrical wall 16 having a stainless steel exhaust gas exit tube 18 at its top. The water containing tank 10 is surrounded by a layer of insulation 20 and a protective metal jacket 22 in the conventional manner.

When the appliance A is in use, the tank 10 is filled with a stratified body of water 24 with the coldest water remaining in the bottom of the tank and the hottest water rising to the top. The water to be heated is introduced into the water containing tank 10 through inlet piping 26 leading through the bottom stainless steel plate 17 of the tank and feeding water to an inlet water diffuser 30. The diffuser 30 is a short, closed stainless steel tube secured within the tank 10 to the bottom plate 17 thereof in vertical position and having apertures 32 along one of its side surfaces through which water is introduced into the tank near its bottom.

Heated water is withdrawn from the tank 10 through an outlet tube 34 which is fixed to a fitting 36 penetrating through the bottom plate 17 of the tank 10 and extends upwardly to the topmost region of the tank 10. The top of outlet tube 34 is open. Heated water passes through this top end opening into the tube 34 and downwardly therethrough and out of the tank 10 and into the outlet hot water piping 38.

Inlet piping 26 and outlet hot water piping 38 are connected to the domestic water piping of the building in which the heater A is disposed, thereby supplying hot water. The inlet piping 26 and outlet hot water piping 38 may also be connected through appropriate valves to a heat exchanger in the space heating and ventilating system to provide heat for the building in accordance with the teachings of the aforementioned Cameron et al U.S. Pat. No. 4,766,883 and Jantana U.S. Pat. No. 4,451,410.

Heat is provided to the body of water 24 from the heat of fuel combustion in combustion chamber 14. The equipment and method of supplying combustion gases to the combustion chamber 14 is described hereinafter with reference to a system using natural gas as the input energy source. Other fuels, such as bottled propane gas can be used with only slight adjustments to the system easily accomplished by those skilled in the art. Use of bottled gas in a system such as this is most appropriate in mobile home, camper and marine applications. Both the hot water for domestic use and the interior space heating in such a vehicle is provided by a single heater such as described herein and in the above mentioned U.S. patents to Cameron et al and Jantana.

When hot water is withdrawn from the water containing tank 10 through the outlet tube 34, additional cold water is drawn into the tank through the inlet water diffuser 30. When sufficient cold water is drawn into the tank 10, the drop in the temperature of the water body 24 is sensed by a water temperature sensor 40. The sensor 40 is connected to the electric control circuitry contained in an electrical control box 42. Appropriate control circuitry is well known in the art and will not be described in detail herein.

In response to the lowered water temperature within the tank 10, an electric igniter 44 located within the bottom region of the combustion chamber 14 is energized. The igniter quickly reaches a temperature sufficiently high to ignite a gas and fuel mixture introduced into the combustion chamber 14 from a burner 50 located therein. A blower 52 is energized and a fuel regulator 54 is turned on. The blower 52 draws air from outside the appliance or the vehicle through air inlet tubing 56 into an air and fuel proportioner 58, as described in the above-mentioned Cameron et al U.S. patent, where fuel is introduced to the air stream and some mixing occurs. The air and fuel is drawn into the body of the blower 52 where it is pressurized and mixed further. A homogeneous air and fuel mixture results.

The blower 52 is one in which the air and fuel intake is near the center portion of the blower body and the output is on the outer periphery of the blower. The pressurized and homogenized air and fuel mixture from. the blower 52 is directed through the output horn 60 of the blower and into the open bottom end of the burner 50 within the combustion chamber 14 through a circular burner inlet opening 62 centrally located in the bottom plate 17 of the tank 10.

Figure 2:
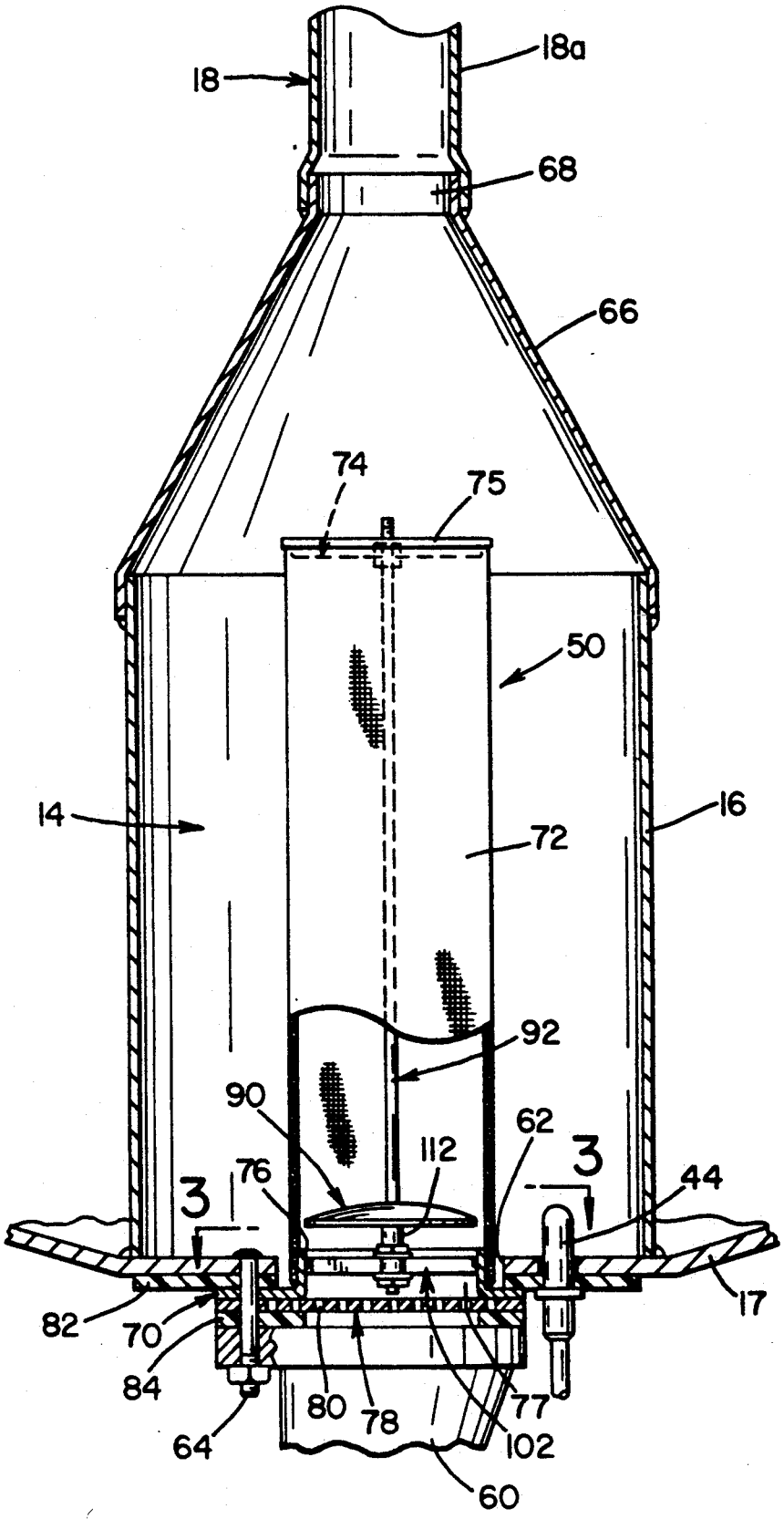
FIG. 2 is a vertical section of the combustion chamber and burner of the appliance shown in FIG. 1.

As can be best seen in FIG. 2, the blower output horn 60 is securely fastened to the tank bottom plate 17 by means of studs 64 passing through the flange of the output horn from the bottom plate 17. The blower output horn 60 is aligned with the burner inlet opening 62. The combustion chamber 14 is contained within the upstanding cylindrical chamber wall 16 thereof which is welded around its lower end periphery to the bottom plate 17 of the water containin9 tank 10. The top of the combustion chamber 14 is defined by a conical combustion chamber top 66 which is welded to the top of the cylindrical combustion chamber wall 16. The combustion chamber top 66 is provided with a top exhaust aperture 68 which communicates with the exhaust gas exit tube 18 only a small portion of which is shown in FIG. 2. The exhaust gas exit tube is welded to the topmost portion of the combustion chamber top 66 in communication with the exhaust aperture 68. The exhaust gas exit tube 18 is comprised of a short vertical segment 18*a* leading upwardly from the combustion chamber 14 and a helical segment 18*b* spiralling downwardly within the water containing tank 10. The lower end 18*c* of the exhaust gas exit tube 18 exits the tank 10 through the tank bottom plate 17 by a welded water-tight seal and is connected to a duct removing exhaust gases from the combustion chamber 14. Like water containing tank 10, the cylindrical combustion chamber wall 16, the conical combustion top 66 and the exhaust gas exit tube 18 are all fabricated from stainless steel.

The burner 50 is contained within the lower portion of the combustion chamber 14 and is essentially comprised of an annular burner mounting plate 70 disposed below and fixedly secured to the tank bottom plate 17, a screen-like cylindrical burner tube 72 upstanding from and secured to the burner mounting plate 70 and extending vertically upward from the burner inlet opening 62 in the tank bottom plate 17 into the combustion chamber 14 centrally thereof, and a burner end cap 74 welded to the top of and closing the burner tube 72 at its top end. All of the elements 70, 72 and 74 of burner 50 are fabricated from stainless steel. The annular burner mounting plate 70 is provided with a short upstanding cylindrical flange 76 bordering the central burner tube inlet opening 77 thereof and extending a short distance upwardly into the circular burner inlet opening 62 which is centrally located in the tank bottom plate 17. The burner tube 72 is welded at its lower end to the upstanding cylindrical flange 76 on the burner mounting plate 70. The burner tube 72 is in the form of a thin walled metal tube formed throughout, in a manner shown as simulating a fine mesh screen, with a multiplicity of fine holes of around 0.024 inch diameter or so arranged in a straight pattern resulting in approximately 517 or so holes per square inch. The mesh is so fine that only about 24% or so of the surface of the burner tube 72 is actually open. The burner end cap 4 is circular and is provided with an upstanding short U-section annular flange 76 extending around its periphery allowing welding of the end cap 74 to the burner tube 72.

A burner distribution plate 78 comprised of a thin sheet of stainless steel having a uniform pattern of small holes 80 therein is disposed just below the burner mounting plate 70 at the interface between the annular burner mounting plate 70 and the blower output horn 60. Appropriate annular gaskets 82 and 84 are inserted in this stack of elements such that the burner 50, burner distribution plate 78, and the blower output horn 60 are all firmly and air tightly fixed to the tank bottom plate 17 by the studs 64.

In operation, the air and gas mixture from blower 52 is forced upwardly through the apertured burner distribution plate 78 into the interior volume of the burner tube 72 and thence laterally outward through the fine screen openings thereof into the combustion chamber 14. The burner distribution plate 78 assures an even distribution of the combustible gas/air mixture within the burner tube 72. The gas/air mixture is forced through the very fine openings in the burner tube 72 and into the combustion chamber 14 where it is ignited by the existing flame front. The combustible gas/air mixture initially introduced into the combustion chamber 14 at the beginning of a heating cycle is ignited by the igniter 44 to establish this flame front. The fine mesh of the perforated burner tube 72 prevents the migration of the flame front to the interior volume of the burner tube 72.

During a normal heating cycle of the apparatus A, the heat of combustion generated outside the burner tube 72 and within the combustion chamber 14 of the apparatus heats the combustion chamber wall 16 and combustion chamber top 66 and hence the body of water 24 surrounding the combustion chamber 14. The hot products of combustion exit the combustion chamber 14 through the exhaust gas exit tube 18. As seen in FIG. 1, the exhaust gas exit tube conveys the hot exhaust gases on a helically downwardly spiralling path through the body of water 24, to further heat the same by conduction of heat through the walls of the exit tube 18, and thence outside of the water containing tank and outside of the building or vehicle in which the heating appliance A is located. The pressurization of the combustion gases and hence the exhaust gases by the blower 52 allows the exhaust gases to follow the convoluted and lengthy heat exchange path described above without the need of a natural draft to convey them to the outside.

The exhaust gas exit tube 18 follows a counterclockwise downward spiral path within the tank 10. The apertures 32 in the inlet water diffuser tube 30 are oriented in the tank 10 such that cool water entering the tank flows in a clockwise upward spiralling direction. The cold water is first brought into contact with the lowest and coolest portion of the exhaust gas exit tube 18 and then spirals upwardly in the tank 10 in a direction opposite to that of the exhaust gases in the exhaust gas exit tube. This forced counterflow brings the coldest water into contact with the coolest portion of the exhaust gas exit tube 18 and brings progressively warmer water against warmer portions of the exhaust gas exit tube. High efficiency heat exchange results.

To substantially prevent any delay in the ignition of the combustible gas/air mixture as it is introduced into the combustion chamber 14 at the start of a heating cycle of the heater appliance A, and substantially eliminate all sputtering of the ignition process at such time, the burner 50 is provided, in accordance with the invention, with a substantially flat metal deflector plate 90 in the burner tube 72 extending transversely thereacross and freely movable vertically therein. For this purpose, the deflector plate 90 is slidably mounted on a guide rod 92 extending vertically of and centrally within the burner tube 72 throughout substantially the full vertical extent thereof and supported therein at its top end within the burner end cap 74 and at its bottom end within the upstanding circular flange or collar 76 on the burner mounting plate 70 providing the opening 77 into the bottom end of the burner tube 72. The guide rod 92 is provided at its top end with a screw thread 94 which extends through a central aperture in the burner end cap 74 and is secured thereto by a pair of clamping nuts 96 threaded onto the screw thread end 94 of the guide rod 92 and fastened tight against opposite sides of the burner end cap 74. The bottom end of the guide rod 92 is likewise provided with a screw thread 98 which extends through an aperture in a central hub portion 100 of a spider mounting bracket 102 disposed within the circular flange 76 of the burner mounting plate 70 and formed with a plurality, i.e. at least three, of radially outward extending support arms 104 equally spaced apart around the hub portion 100 and having laterally bent outer ends 106 which are welded to the inside of the circular flange 76 of mounting plate 70. The screw threaded lower end 98 of the guide rod 92 is secured to the hub portion 100 of the spider bracket 102 by a pair of clamping nuts 108 threaded onto the screw threaded lower end of the guide rod 92 and fastened tight against the opposite ends of the hub portion 100 of bracket 102. The openings 110 between the support arms 104 of the spider mounting bracket 102 provide passageways for the passage of the gas/air mixture upwardly into the burner tube 72 from the blower 52.

Figure 4:
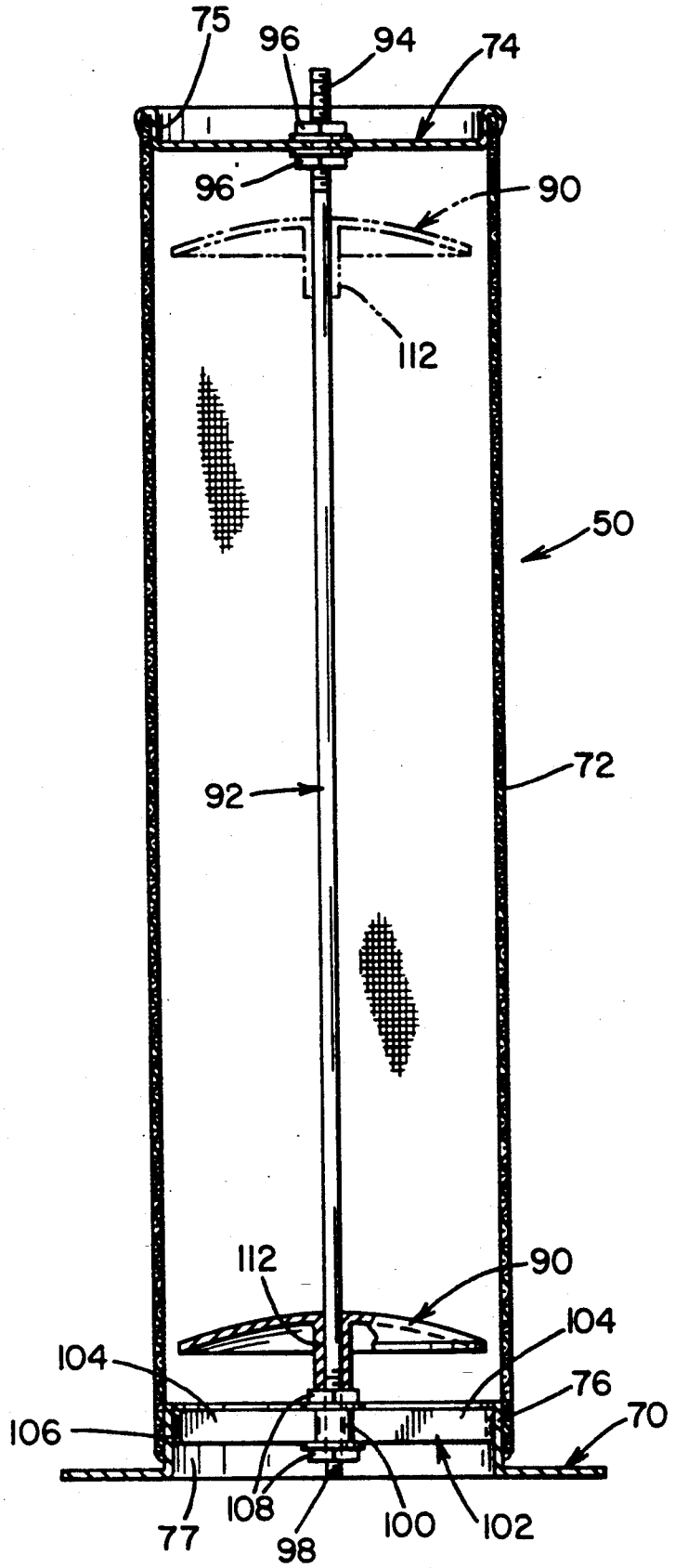
FIG. 4 is an enlarged vertical section of the burner comprising the invention, showing the deflector plate thereof in its lowered inoperative position and in phantom in its upper operative position.

The deflector plate or disc 90 is preferably of slightly downwardly facing dished or concave form, as shown, and it substantially conforms in contour to and is centered within, and transversely spans a substantial or major portion, e.g., at least around 75%, of the interior cross-sectional area of the tubular burner or cylindrical burner tube 72 so as to intercept and deflect the major portion of the combustible gas/air mixture laterally outwardly of the burner tube 72 and into the combustion chamber 14 as it is initially forced upwardly into the burner tube 72 by the blower 52. To assure free and easy vertical sliding movement of the deflector plate 90 on the guide rod 92 and maintain it in true transverse position thereon at all times against cocking at an angle during its vertical sliding movement along the guide rod as it is pushed upwardly within the burner tube 72 by the force of the pressurized gas/air mixture from the blower 52, the deflector plate 90 is provided with a vertically extended central bushing member 112 having a close sliding fit on the guide rod. During the idle period when the burner 50 is not operating to heat the body of water 24 in the tank 10, the deflector plate 90 is in a lowered or inoperative position at the bottom of the burner tube 72 as shown in full lines in FIG. 4, with the bushing 112 resting against the top nut 108 clamping the guide rod 92 to the spider mounting bracket 102. During the operative heating cycle of the burner 50 the deflector plate is pushed up the guide rod 92 by the pressurized gas/air mixture from the blower 52 to its top or operative position within the burner tube 72 near or at the top thereof, as shown in phantom in FIG. 4. At the end of the heating cycle, when the blower 52 is turned off, the deflector plate 90 drops and slides downwardly along the guide rod 92 and returns to its lowered or inoperative position thereon at the bottom of the burner tube 72.

The deflector plate or disc 90 performs two functions during each heating cycle of the burner 50. Initially, when the blower 52 first comes on, the gas/air mixture initially entering the bottom of the burner tube 72 moves the deflector plate 90 upwardly in the burner tube part way along vertical guide rod 92 and is immediately distributed and directed by the partially raised deflector plate laterally outward of the burner tube 72 toward the ignition source 44 located within the bottom region of the combustion chamber 14. This laterally outward directed initially entering gas/air mixture is then immediately ignited in the combustion chamber 14 by the ignition source 44, thereby reducing the ignition time of the gas/air mixture from the burner 50 to a minimum and so minimizing or preventing any delay therein.

Secondly, when the gas/air mixture initially entering the combustion chamber 14 from the bottom of the burner tube 72 is thus first ignited and the back pressure of such initial ignition is created within the combustion chamber, the deflector plate 90, which at such time is still in a lowered position near the bottom region of the burner tube 72, then directs this initial back pressure away from the burner tube inlet opening 77 in the burner mounting plate 70 and instead upwardly of the combustion chamber 14 toward the exhaust gas exit tube 18 at the top thereof. This, in effect, eliminates any temporary break in the combustion process and minimizes or eliminates the heretofore prevalent sputtering effect of the ignition of the gas/air mixture within the combustion chamber 14. This, in turn, results in the smooth ignition of the gas/air mixture within the combustion chamber 14 at the start of each heating cycle of the apparatus A.

In place of being formed of downwardly facing concave shape as shown in the drawings, the deflector plate or disc 90 may be made instead of simple flat plate form as shown at 90' in FIGS. 5 and 6, or of slightly upwardly facing dished or concave form as shown at 90" in FIG. 7. The upwardly dished form of deflector plate 90" works better with, and is preferred for use where leaner gas/air mixtures are fed to the burner 50. Also, it may be shaped to have flanges of small height on it such as an annular depending flange around its periphery, or depending radial extending flanges, and it may be of square or any other desired contour shape. The size of the deflector plate 90 may also vary based on the shape and arrangement of the combustion train.

From the above description, it will be evident that we have provided an improved burner construction for powered combustion systems which not only reduces the delay in the ignition of the combustible gas/air mixture in the combustion chamber of such systems but also effectively minimizes or eliminates the sputtering ignition of the combustible gas/air mixture which heretofore has been commonly present in such powered combustion systems and instead insures a smooth ignition of the combustible gas/air mixture therein.

Although the improved burner construction has been described herein for particular use in power assist type water heating appliances, it should be understood that it may be employed as well in other type of gas fired power assist heating apparatus such as in furnaces, for example.

Having thus described the invention, it is claimed:

1. A powered assist type gas burning heating apparatus comprising an outer chamber, a closed inner combustion chamber sealed within said outer chamber, a burner comprising a burner tube disposed vertically within said combustion chamber and having an open lower end, a closed upper end, and a multiplicity of fine openings in the wall thereof, a blower for forcing a combustible gas/air mixture upwardly into the said burner tube through the said lower end thereof and out through the said burner tube wall openings into the said combustion chamber, and igniter means located within the said combustion chamber at the bottom region thereof for igniting the said combustible gas/air mixture therein, said burner tube having a deflector plate supported in a transverse position therein for free vertical movement in said transverse position from a lowered inoperative idle position in said burner tube to an upper operative position therein by the pressure thereagainst of the said combustible gas/air mixture as it is forced upwardly into the burner tube by said blower at the start of a heating cycle of the said apparatus, said deflection plate operative to be moved part way upwardly in the said burner tube by the combustible gas/air mixture initially entering the bottom of the burner tube from the said blower and to thereby deflect laterally out through the said burner tube openings at the bottom region of the burner tube and into the bottom region of the said combustion chamber the said initially entering combustible gas/air mixture to cause immediate ignition thereof in said combustion chamber by the said igniter means.

2. The heating apparatus as defined in claim 1, wherein the said deflector plate comprises a substantially flat member centrally located within and spanning a major portion of the transverse interior cross-sectional area of the said burner tube.

3. A heating apparatus as defined in claim 2, wherein the said deflector plate spans at least around 75% of the interior cross-sectional area of the said burner tube.

4. A heating apparatus as defined in claim 1, wherein thes aid deflector plate comprises a downwardly facing concave member centrally located within and spanning a major portion of the transverse interior cross-sectional area of the said burner tube.

5. A heating apparatus as defined in claim 4, wherein the said deflector plate spans at least around 75% of the interior cross-sectional area of the said burner tube.

6. A heating apparatus as defined in claim 1, wherein the said deflector plate comprises an upwardly facing concave member centrally located within and spanning a major portion of the transverse interior cross-sectional area of the said burner tube.

7. A heating apparatus as defined in claim 6, wherein the said deflector plate spans at least around 75% of the interior cross-sectional area of the said burner tube.

8. A heating apparatus as defined in claim 1, wherein the said deflector plate spans at least around 75% of the interior cross-sectional area of the said burner tube.

9. A heating apparatus as defined in claim 1, wherein the said deflector plate is slidably mounted for vertical sliding movement in said burner tube on vertically extending slide guide means in said burner tube.

10. A heating apparatus as defined in claim 9, wherein the said slide guide means is supported at its top end within the said closed top end of said burner tube and is supported at its bottom end by a spider mounting bracket fastened within the said open bottom end of said burner tube.

11. A heating apparatus as defined in claim 1, wherein the said deflector plate is slidably mounted for vertical sliding movement in said burner tube on a vertically extending guide rod supported centrally within the said burner tube.

12. A heating apparatus as defined in claim 11, wherein the said guide rod is supported at its top end within the said closed top end of said burner tube and is supported at its bottom end by a spider mounting bracket fastened within the said open bottom end of said burner tube.

13. A heating apparatus as defined in claim 11, wherein the said deflector plate is provided with a bushing of extended length fixed thereon and having a closed sliding fit on said guide rod.

14. A heating apparatus as defined in claim 12, wherein the said spider mounting bracket comprises a central hub portion and at least three arm portions extending radially outward from said hub portion and fastened at their outer ends within the said open bottom end of said burner tube, said arm portions being spaced apart around the said hub portion to provide passageways through the open bottom end of said burner tube for the combustible gas/air mixture from said blower.

15. A heating apparatus as defined in claim 14, wherein the said guide rod is fastened at its bottom end to the said hub portion of said spider mounting bracket.

16. A heating apparatus as defined in claim 14, wherein the said burner further comprises a burner mounting plate secured to the underside of the bottom plate of said outer chamber and having a short upstanding annular flange bordering a center opening in said mounting plate and extending into the burner inlet opening in the said chamber bottom plate, said burner tube being welded at its lower end to the said annular flange on the burner mounting plate.

17. A powered assist type gas burning water heating appliance comprising a tank for containing a body of water to be heated, a closed combustion chamber sealed within said tank for heating the said body of water by conduction of heat thereto from the walls of said combustion chamber, a burner comprising a burner tube disposed vertically within said combustion chamber and having an open lower end, a closed upper end, and a multiplicity of fine openings in the wall thereof, a blower for forcing a combustible gas/air mixture into the said burner tube through the said open lower end thereof and out through the said burner tube wall openings into the said combustion chamber, and igniter means located within the said combustion chamber at the bottom region thereof for igniting the said combustible gas/air mixture therein, said burner tube having a deflector plate supported in a transverse position therein for free vertical movement in said transverse position from a lowered inoperative idle position in the said burner tube to an upper operative position therein by the pressure thereagainst of the said combustible gas/air mixture as it is forced upwardly into the burner tube by said blower at the start of a heating cycle of the said appliance, said deflector plate operative to be moved part way upwardly in the said burner tube by the combustible gas/air mixture initially entering the bottom of the burner tube from the said blower and to thereby deflect laterally out through the said burner tube openings at the bottom region of the burner tube and into the bottom region of the said combustion chamber the said initially entering combustible gas/air mixture to cause immediate ignition thereof in said combustion chamber by the said igniter means.

18. A water heating appliance as defined in claim 17, wherein the said deflector plate comprises a substantially flat member centrally located within and spanning a major portion of the transverse interior cross-sectional area of the said burner tube.

19. A water heating appliance is defined in claim 18, wherein the said deflector plate spans at least around 75% of the interior cross-sectional area of the said burner tube.

20. A water heating appliance as defined in claim 17, wherein the said deflector plate comprises a downwardly facing concave member centrally located within and spanning a major portion of the transverse interior cross-sectional area of the said burner tube.

21. A water heating appliance as defined in claim 20 wherein the said deflector plate spans at least around 75% of the interior cross-sectional area of the said burner tube.

22. A water heating appliance as defined in claim 17, wherein the said deflector plate comprises an upwardly facing concave member centrally located within and spanning a major portion of the transverse interior cross-sectional area of the said burner tube.

23. A water heating appliance as defined in claim 22, wherein the said deflector plate spans at least around 75% of the interior cross-sectional area of the said burner tube.

24. A water heating appliance as defined in claim 17, wherein the said deflector plate is slidably mounted for vertical sliding movement in said burner tube on vertically extending slide guide means in said burner tube.

25. A water heating appliance as defined in claim 24, wherein the said slide guide means is supported at its top end within the said closed top end of said burner tube and is supported at its bottom end by a spider mounting bracket fastened within the said open bottom end of said burner tube.

26. A water heating appliance as defined in claim 17, wherein the said deflector plate is slidably mounted for vertical sliding movement in said burner tube on a vertically extending guide rod supported centrally within the said burner tube.

27. A water heating appliance as defined in claim 26, wherein the said guide rod is supported at its top end within the said closed top end of said burner tube and is supported at its bottom end by a spider mounting bracket fastened within the said open bottom end of said burner tube.

28. A water heating appliance as defined in claim 26, wherein the said reflector plate is provided with a bushing of extended length fixed thereon and havin9 a close sliding fit on said guide rod.

29. A water heating appliance as defined in claim 27, wherein the said spider mounting bracket comprises a central hub portion and at least three arm portions extending radially outward from said hub portion and fastened at their outer ends within the said open bottom end of said burner tube, said arm portions being spaced apart around the said hub portion to provide passageways through the open bottom end of said burner tube for the combustible gas/air mixture from said blower.

30. A water heating appliance as defined in claim 29, wherein the said guide rod is fastened at its bottom end to the said hub portion of said spider mounting bracket.

31. A water heating appliance as defined in claim 29, wherein the said burner further comprises a burner mounting plate secured to the underside of the bottom plate of said tank and having a short upstanding annular flange bordering a center opening in said mounting plate and extending into the burner inlet opening in the said tank bottom plate, said burner tube being welded at its lower end to the said annular flange on the burner mounting plate.

32. A burner for a powered assist type gas burning heating appliance comprising a burner mounting plate having a burner inlet opening bordered by an upstanding peripheral flange, a burner tube secured at an open one end in upright position on said burner mounting plate with its said open end in communication with said burner inlet opening, said burner tube being closed at its other end and provided with a multiplicity of fine holes in the wall thereof to form the tube of screen-like fine mesh form, and a deflector plate supported in a transverse position in said burner tube for free vertical movement in said transverse position from a lowered inoperative position in said burner tube to an upper operative position therein by the pressure thereagainst of the combustible gas/air mixture forced upwardly into the burner tube through the said open end thereof during a heating cycle of said appliance.

33. A burner as defined in claim 32, wherein the said deflector plate comprises a substantially flat member spanning a major portion of the transverse interior cross-sectional area of the said burner tube.

34. A burner as defined in claim 33, wherein the said deflector plate spans at least around 75% of the interior cross-sectional area of the said burner tube.

35. A burner as defined in claim 32, wherein the said deflector plate comprises a downwardly facing concave member spanning a major portion of the transverse interior cross-sectional area of the said burner tube.

36. A burner as defined in claim 35, wherein the said deflector plate spans at least around 75% of the interior cross-sectional area of the said burner tube.

37. A burner as defined in claim 32, wherein the said deflector plate comprises an upwardly facing concave member spanning a majority of the transverse interior cross-sectional area of the said burner tube.

38. A burner as defined in claim 37, wherein the said deflector plate spans at least around 75% of the interior cross-sectional area of the said burner tube.

39. A burner as defined in claim 32, wherein the said deflector plate spans at least around 75% of the interior cross-sectional area of the said burner tube.

40. A burner as defined in claim 32, wherein the said deflector plate is slidably mounted for vertical sliding movement in said burner tube on a vertically extending slide guide means in said burner tube.

41. A burner as defined in claim 40, wherein the said slide guide means is supported at its bottom end by a spider mounting bracket fastened within the said open one end of said burner tube and is supported at its said other end within the said closed other end of said burner tube.

42. A burner as defined in claim 32, wherein the said deflector plate is slidably mounted for vertical sliding movement in said burner tube on a vertically extending guide rod supported centrally within the said burner tube.

43. A burner as defined in claim 42, wherein the said guide rod is supported at its bottom end by a spider mounting bracket fastened within the said open one end of said buner tube and is supported at its said other end within the said closed other end of said burner ube.

44. A burner as defined in claim 42, wherein the said deflector plate is provided with a bushing of extended length fixed thereon and having a close sliding fit on said guide rod.

45. A burner as defined in claim 43, wherein the said spider mounting bracket comprises a central hub portion and at least three arm portions extending radially outward from said hub portion and fastened at their outer ends within the said open one end of said burner tube, said arm portions being spaced apart around the said hub portion to provide passageways through the open bottom end of said burner tube for the combustible gas/air mixture fed to the burner.

46. A burner as defined in claim 45, wherein the said guide rod is fastened at its bottom end to the said hub portion of said spider mounting bracket.

47. A burner as defined in claim 45, wherein the said burner tube is welded at its said open one end to the said peripheral flange bordering the burner inlet opening of the said burner mounting plate.

* * * * *

UNITED STATES PATENT AND TRADEMARK OFFICE

CERTIFICATE OF CORRECTION

PATENT NO. : 5,085,579

DATED : February 4, 1992

INVENTOR(S) : Henry J. Moore, Jr.; Bijan Gidanian

It is certified that error appears in the above-identified patent and that said Letters Patent is hereby corrected as shown below:

Title page, Item [56], after "5,022,352 6/1991" change "Osborn" to read --Osborne et al.--.

Column 5, line 37, "containin9" should read --containing--.

Column 6, line 16, "4" should read --74--; and line 18, "76" should read --75--.

Claim 1, column 9, lines 40-41, "deflection" should read --deflector--.

Claim 4, column 9, line 59, "thes aid" should read --the said--.

Claim 13, column 10, line 33, "closed" should read --close--.

Claim 28, column 12, line 2, "reflector" should read --deflector--; and line 3, "havin9" should read --having--.

Claim 43, column 13, line 17, "buner" should read --burner--.

Signed and Sealed this

Sixth Day of July, 1993

*Attest:*

Michael K. Kirk

MICHAEL K. KIRK

*Attesting Officer*

*Acting Commissioner of Patents and Trademarks*